US009242474B2

(12) United States Patent
Kobayashi et al.

(10) Patent No.: US 9,242,474 B2
(45) Date of Patent: Jan. 26, 2016

(54) PRINTING APPARATUS

(71) Applicant: SEIKO EPSON CORPORATION, Tokyo (JP)

(72) Inventors: Yoshihiro Kobayashi, Matsumoto (JP); Toshio Kumagai, Shiojiri (JP); Norihiro Masuda, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/167,517

(22) Filed: Jan. 29, 2014

(65) Prior Publication Data

US 2014/0225959 A1 Aug. 14, 2014

(30) Foreign Application Priority Data

Feb. 14, 2013 (JP) ..... 2013-026335

(51) Int. Cl.
*B41J 2/165* (2006.01)
*B41J 2/19* (2006.01)
*B41J 2/175* (2006.01)

(52) U.S. Cl.
CPC ... *B41J 2/19* (2013.01); *B41J 2/175* (2013.01)

(58) Field of Classification Search
CPC .... B41J 2/1714; B41J 2/20; B41J 2002/1742; B41J 2/16508; B41J 2/185
USPC ..... 347/34
See application file for complete search history.

(56) References Cited

U.S. PATENT DOCUMENTS

| | | | | |
|---|---|---|---|---|
| 2,336,017 | A * | 12/1943 | Jewell et al. | 34/369 |
| 2001/0002952 | A1* | 6/2001 | Sakai | 399/250 |
| 2001/0050017 | A1* | 12/2001 | Ohsawa et al. | 101/465 |
| 2006/0086253 | A1* | 4/2006 | Gaur et al. | 96/321 |
| 2007/0007215 | A1* | 1/2007 | Lawrence et al. | 210/726 |
| 2007/0163385 | A1* | 7/2007 | Takahashi et al. | 75/346 |
| 2007/0180661 | A1 | 8/2007 | Aga et al. | |
| 2008/0238980 | A1* | 10/2008 | Nagashima et al. | 347/17 |
| 2010/0064951 | A1* | 3/2010 | Storm et al. | 110/216 |
| 2010/0225013 | A1 | 9/2010 | Eiha et al. | |

FOREIGN PATENT DOCUMENTS

| | | |
|---|---|---|
| JP | 2001-166596 | 6/2001 |
| JP | 2004-074008 | 3/2004 |
| JP | 2007-160871 | 6/2007 |
| JP | 2007-216213 | 8/2007 |
| JP | 2009-069774 | 4/2009 |
| JP | 2009-220499 | 10/2009 |

* cited by examiner

*Primary Examiner* — Manish S Shah
*Assistant Examiner* — Yaovi Ameh
(74) *Attorney, Agent, or Firm* — Workman Nydegger

(57) ABSTRACT

A printing apparatus which performs printing by ejecting liquid onto a printing medium includes a gas flow generating section that generates a gas flow to collect and exhaust liquid not used for printing, and a gas-liquid separation cyclone that swirls the gas flow so that the liquid is centrifugally separated from a gas which moves along the gas flow, wherein the gas flow generating section exhausts the gas along the gas flow after the liquid is separated from the gas by the gas-liquid separation cyclone.

11 Claims, 4 Drawing Sheets

PRINTING APPARATUS

BACKGROUND

1. Technical Field

The present invention relates to a technique to collect liquid not used for printing in a printing apparatus that performs printing by ejecting liquid onto a printing media.

2. Related Art

JP-A-2007-160871 describes a suction means that collects ink mist generated in an ink jet recording apparatus by using a suction fan. The suction means collects a gas which contains ink mist through a suction port that opens toward the interior of the apparatus by using a suction fan. Further, the suction means performs gas-liquid separation to separate ink from the collected gas, and then exhausts a clean gas from which ink has been removed to the outside of the apparatus.

Further, JP-A-2007-160871 describes that a filter is used to perform gas-liquid separation. Specifically, the filter is disposed between the suction port and the suction fan such that a gas is suctioned through the suction port and passes through the filter. In so doing, ink contained in the gas which passes through the filter is captured by the filter, thereby performing gas-liquid separation.

In a configuration to perform gas-liquid separation by using a filter, the liquid captured by the filter is gradually accumulated on the filter. This leads to filter clogging and decreases the efficiency of gas-liquid separation. Accordingly, the filter needs to be replaced as appropriate. However, such replacement of the filter may increase the burden of an operator.

SUMMARY

An advantage of some aspects of the invention is that the technique capable of reducing the burden of the operator is provided in a printing apparatus that performs gas-liquid separation by collecting a gas which contains liquid not used for printing and by separating the liquid from the gas.

According to a first aspect of the invention, a printing apparatus which performs printing by ejecting liquid onto a printing medium includes a gas flow generating section that generates a gas flow to collect and exhaust liquid not used for printing, and a gas-liquid separation cyclone that swirls the gas flow so that the liquid is centrifugally separated from a gas which moves along the gas flow, wherein the gas flow generating section exhausts the gas along the gas flow after the liquid is separated from the gas by the gas-liquid separation cyclone.

In the invention having the above configuration (printing apparatus), the gas-liquid separation cyclone that performs gas-liquid separation by centrifuge is used. The gas-liquid separation cyclone does not use a filter in gas-liquid separation, and accordingly, does not require replacement of a filter. As a result, the burden of an operator can be reduced.

In the printing apparatus, the liquid may be a light curable liquid which is cured by light irradiation. The light curable liquid is cured by light irradiation, not by drying. Accordingly, even if the light curable liquid is attached to the gas-liquid separation cyclone during gas-liquid separation, the light curable liquid flows down without being dried and cured. As a result, it is possible to prevent the efficiency of gas-liquid separation from being decreased due to the dried and cured ink adhering to the gas-liquid separation cyclone, and maintain a good effect of gas-liquid separation.

Further, the printing apparatus may further include a filter disposed downstream with respect to the gas flow of the gas-liquid separation cyclone, and the gas flow generating section may exhaust the gas which passes through the filter after the liquid is separated from the gas by the gas-liquid separation cyclone. Accordingly, the liquid which has not been separated by the gas-liquid separation cyclone can be removed by the filter. The gas to be removed by the filter contains a significantly small amount of liquid since gas-liquid separation by the gas-liquid separation cyclone has been already performed. Accordingly, the amount of liquid captured by the filter is significantly small, and clogging of the filter progresses slowly. Therefore, replacement frequency of the filter is decreased, and the burden of the operator required for replacement of the filter is relatively small.

In the printing apparatus, the filter may be disposed above the gas-liquid separation cyclone in the gravitational direction. In this configuration, even if the liquid captured by the filter drops, the dropped liquid flows in the direction opposite to the flow of the gas flow and can be prevented from being discharged to the outside of the printing apparatus.

Further, the printing apparatus may further include a cover member that covers a portion between the gas-liquid separation cyclone and the filter, and a notification section that notifies a time for replacing the filter based on a measurement result of a pressure in the cover member. In this configuration, as the liquid captured by the filter increases, the speed of the gas flow passing through the filter decreases and the pressure in the cover member increases. A time for replacing the filter is notified based on the measurement result of the pressure in the cover member. Accordingly, replacement of filter can be performed at an appropriate time.

Further, the printing apparatus may further include a light irradiation section that irradiates a light to the filter. In this configuration, the liquid captured by the filter can be cured and adhered to the filter. As a consequence, the increase in the pressure in the cover member to the increase in the amount of ink captured by the filter can be measured with improved sensitivity, and replacement of filter at an appropriate time can be more reliably performed.

In the printing apparatus, the light irradiation section may irradiate a light to the filter from a downstream side in the gas flow. In this configuration, a substantially entire area of the filter can be effectively used to capture the liquid. Accordingly, the amount of liquid captured by the filter before the replacement time can be ensured and the replacement frequency of the filter can be decreased.

Further, in the printing apparatus, the filter may include a coagulant that coagulates the liquid. Such a configuration is advantageous in that the liquid captured by the filter can be more fixedly adhered to the filter and the filter can be replaced an appropriate time.

Further, the printing apparatus may include a discharge section that discharges the liquid separated by the gas-liquid separation cyclone through the discharge port that communicates with the gas-liquid separation cyclone. In this configuration, the liquid separated by the gas-liquid separation cyclone can be discharged through the discharge port as appropriate.

Further, the printing apparatus may include a storage container that is disposed between the gas-liquid separation cyclone and the discharge port and is configured such that the liquid separated by the gas-liquid separation cyclone is stored in the storage container, wherein the liquid stored in the storage container is discharged through the discharge port. In this configuration, the liquid separated by the gas-liquid separation cyclone can be temporarily stored in the collecting box and a timing at which the liquid is discharged can be controlled as appropriate.

Further, in the printing apparatus, the discharge port may be closed while the gas flow generating section generates the gas flow and the discharge port may be opened while the gas flow generating section does not generate the gas flow. In this configuration, the liquid is discharged through the discharge port while the gas flow generating section does not generate the gas flow, and the liquid is not discharged through the discharge port while the gas flow generating section generates the gas flow, that is, while the gas-liquid separation cyclone performs gas-liquid separation. Accordingly, it is possible to avoid a situation that discharge of the liquid through the discharge port disturbs the gas flow which is necessary for gas-liquid separation and the efficiency of gas-liquid separation decreases.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
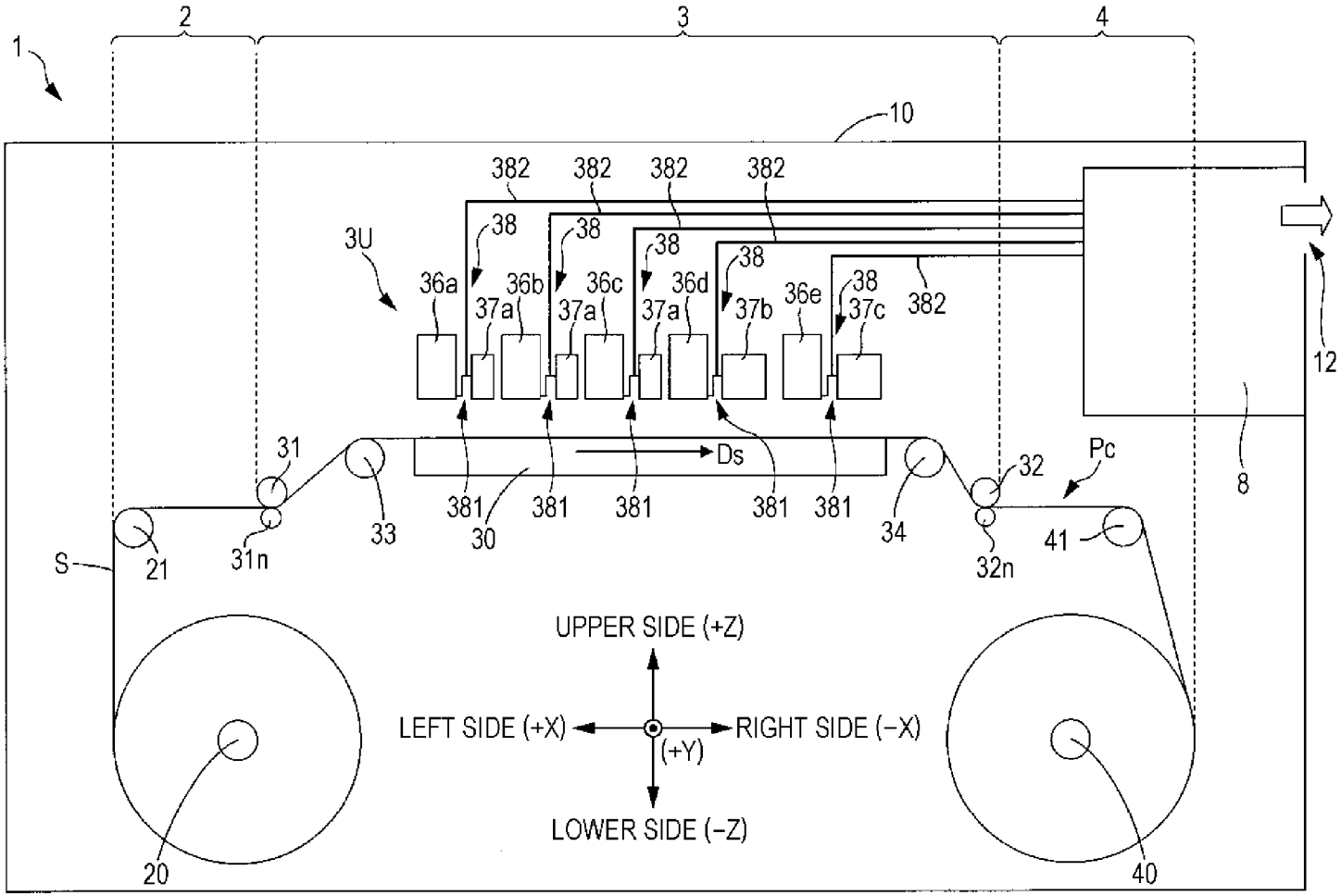
FIG. 1 is a front view which schematically shows one example of an image recording apparatus to which the invention can be applied.

FIG. 1 is a front view which schematically shows one example of an image recording apparatus to which the invention can be applied. In FIG. 1 and the subsequent figures, the XYZ orthogonal coordinate system which corresponds to the right-left direction X, front-back direction Y and vertical direction Z of an image recording apparatus 1 is indicated to clarify the positional relationship of components of the apparatus.

As shown in FIG. 1, in an exterior member 10 of the image recording apparatus 1, a feeding section 2, a processing section 3, and a winding section 4 are arranged in the right-left direction X. The feeding section 2 and the winding section 4 have a feeding shaft 20 and a winding shaft 40, respectively. A sheet S (web) extends between the feeding section 2 and the winding section 4 with the both end portions of the sheet S being wound around the feeding section 2 and the winding section 4 into a roll. The sheet S is transported from the feeding shaft 20 to the processing section 3 along a transportation path Pc. An image recording process is performed on the sheet S by a head unit 3U, and then, the sheet S is transported to the winding shaft 40. The sheet S is roughly divided into paper and film types. Specifically, paper type sheet S includes high-quality paper, cast paper, art paper and coated paper, and film type sheet S includes synthetic paper, PET (polyethylene terephthalate) and PP (polypropylene). In the following description, one surface of the sheet S on which an image is printed is referred to as a front surface, while the other surface is referred to as a rear surface.

The feeding section 2 includes the feeding shaft 20 around which the end of the sheet S is wound and a driven roller 21 around which the sheet S unwound from the feeding shaft 20 is wound. The feeding shaft 20 around which the end of the sheet S is wound supports the sheet S with the front surface of the sheet S facing the outside. When the feeding shaft 20 rotates in the clockwise direction on the plane of FIG. 1, the sheet S wound around the feeding shaft 20 is fed to the processing section 3 via the driven roller 21.

The processing section 3 performs image recording on the sheet S by the head unit 3U disposed along the surface of a platen 30 while supporting the sheet S which has been fed from the feeding section 2 on the flat type platen 30 having a flat surface. In the processing section 3, a front driving roller 31 and a back driving roller 32 are disposed on each side of the platen 30. While the sheet S transported from the front driving roller 31 to the back driving roller 32 is supported by the platen 30, image printing is performed on the sheet S.

A plurality of fine projections is formed by thermal spray on the outer peripheral surface of the front driving roller 31, and the front surface of the sheet S which has been fed from the feeding section 2 is wound around the front driving roller 31. When the front driving roller 31 rotates in the counter-clockwise direction on the plane of FIG. 1, the sheet S which has been fed from the feeding section 2 is transported downstream to the transportation path Pc. Further, a nip roller 31*n* is disposed for the front driving roller 31. The nip roller 31*n* is biased toward the front driving roller 31 and is in contact with the back surface of the sheet S so that the sheet S is nipped between the front driving roller 31 and the nip roller 31*n*. Accordingly, a frictional force is generated between the front driving roller 31 and the sheet S, which allows the sheet S to be surely transported by the front driving roller 31.

The flat type platen 30 is supported by a supporting mechanism, which is not shown in the figure, such that the surface (top surface) on which the sheet S is supported is horizontally oriented. Driven rollers 33, 34 are each disposed on each side of the platen 30 in the right-left direction X, and the back surface of the sheet S which is transported from the front driving roller 31 to the back driving roller 32 is wound around the driven rollers 33, 34. The upper end positions of the driven rollers 33, 34 are flush with or slightly below the surface of the platen 30. Accordingly, the sheet S which is transported from the front driving roller 31 to the back driving roller 32 can remain in contact with the platen 30.

A plurality of fine projections is formed by thermal spray on the outer peripheral surface of the back driving roller 32, and the front surface of the sheet S which has been transported from the platen 30 via the driven roller 34 is wound around the back driving roller 32. When the back driving roller 32 rotates in the counter-clockwise direction on the plane of FIG. 1, the sheet S is transported to the winding section 4. Further, a nip roller 32*n* is disposed for the back driving roller 32. The nip roller 32*n* is biased toward the back driving roller 32 and is in contact with the back surface of the sheet S so that the sheet S is nipped between the back driving roller 32 and the nip roller 32*n*. Accordingly, a frictional force is generated between the back driving roller 32 and the sheet S, which allows the sheet S to be reliably transported by the back driving roller 32.

As described above, the sheet S which is transported from the front driving roller 31 to the back driving roller 32 is transported in a transportation direction Ds on the platen 30 while being supported by the platen 30. The head unit 3U is disposed in the processing section 3 so that printing of color image is performed on the front surface of the sheet S which is supported by the platen 30. Specifically, the head unit 3U includes four print heads 36*a* to 36*d* which are arranged from upstream to downstream in the transportation direction Ds. The print heads 36*a* to 36*d* correspond to yellow, cyan, magenta and black, respectively. The print heads 36*a* to 36*d* faces the front surface of the sheet S which is supported by the platen 30 with a small clearance interposed between the print heads 36*a* to 36*d* and the sheet S. The print heads 36*a* to 36*d* eject the corresponding color of ink through the respective nozzles in an ink jet method. When ink is ejected from the respective print heads 36*a* to 36*d* onto the sheet S which is transported in the transportation direction Ds, a color image is formed on the front surface of the sheet S.

The ink used is an ultraviolet (UV) ink (light curable ink) which is cured by irradiation of ultraviolet (light). The head unit 3U includes a UV lamps 37*a*, 37*b* for curing ink and fixing ink on the sheet S. The curing of ink is performed in two steps of temporary curing and permanent curing. The UV lamps 37*a* for temporary curing are disposed between each of the print heads 36*a* to 36*d*. That is, the UV lamp 37*a* irradiates a weak UV light to cure the ink to the extent that the shape of ink is not collapsed (temporary curing), and does not completely cure the ink. The UV lamp 37*b* for permanent curing is disposed downstream to the print heads 36*a* to 36*d* in the transportation direction Ds. That is, the UV lamp 37*b* irradiates a UV light stronger than the UV lamp 37*a* does to completely cure the ink (permanent curing). In this way, the color image formed by the print heads 36*a* to 36*d* is fixed on the front surface of the sheet S by performing temporary curing and permanent curing.

Further, the head unit 3U includes a print head 36*e* downstream to the UV lamp 37*b* in the transportation direction Ds. The print head 36*e* faces the front surface of the sheet S which is supported by the platen 30 with a small clearance interposed between the print head 36*e* and the sheet S. The print head 36*e* eject a transparent UV ink through nozzles in an ink jet method. That is, the transparent UV ink is ejected on the color image formed by the four print heads 36*a* to 36*d*. Further, the head unit 3U includes a UV lamp 37*c* downstream to the print head 36*e* in the transportation direction Ds. The UV lamp 37*c* irradiates a strong UV light to completely cure the transparent ink ejected by the print head 36*e* (permanent curing). Accordingly, the transparent ink is fixed on the front surface of the sheet S.

In this way, in the processing section 3, ejection and curing of ink are appropriately performed on the sheet S supported by the platen 30, thereby forming the color image coated with the transparent ink. Then, the sheet S on which the color image is formed is transported by the back driving roller 32 to the winding section 4.

The winding section 4 includes the winding shaft 40 around which the end of the sheet S is wound and a driven roller 41 around which the sheet S to be transported to the winding shaft 40 is wound. The winding shaft 40 around which the end of the sheet S is wound supports the sheet S with the front surface of the sheet S facing the outside. When the winding shaft 40 rotates in the clockwise direction on the plane of FIG. 1, the sheet S is wound around the winding shaft 40 via the driven roller 41.

In the image recording apparatus 1 that records an image on the sheet S by ejecting ink from the print heads 36*a* to 36*e*, part of the ink ejected from the print heads 36*a* to 36*e* does not land on the sheet S and is suspended in a mist form. Such an ink mist may contaminate the sheet S or components of the apparatus. Accordingly, the image recording apparatus 1 is provided with a collecting mechanism that collects ink suspended around the print heads 36*a* to 36*e* in a mist form (ink mist). As described below, the ink collecting mechanism briefly includes mist suction sections 38 and a gas-liquid separation section 8.

As shown in FIG. 1, the head unit 3U includes a plurality of mist suction sections 38 which are arranged in the right-left direction X. Specifically, the mist suction sections 38 are each disposed between the print heads 36*a* to 36*e* and the UV lamps 37*a* to 37*c*. In other words, the mist suction sections 38 are disposed adjacent and downstream to each of the print heads 36*a* to 36*e* in the transportation direction Ds.

The mist suction sections 38 each have a suction port 381 that opens downward in the vertical direction Z at positions between the print heads 36*a* to 36*e* and the UV lamps 37*a* to 37*c*. The positions of the suction ports 381 are at the same level or slightly above the nozzle forming surfaces of the print heads 36*a* to 36*e* in the vertical direction Z. Each of the suction ports 381 extend in the front-back direction Y and have the substantially same length as that of nozzle rows formed by a plurality of nozzles arranged in the front-back direction Y on each of the print heads 36*a* to 36*e*.

Further, the mist suction sections 38 each have a suction hose 382 provided for each of the suction ports 381. The suction ports 381 are connected to the gas-liquid separation section 8 via the corresponding suction hoses 382. When the gas-liquid separation section 8 generates a negative pressure, a gas flow flows into the gas-liquid separation section 8 through the suction ports 381 via the suction hoses 382 and exits the gas-liquid separation section 8 through an exhaust port 12 formed on the exterior member 10. The ink mist is suctioned by the gas flow from the suction ports 381 to the gas-liquid separation section 8.

Figure 2:
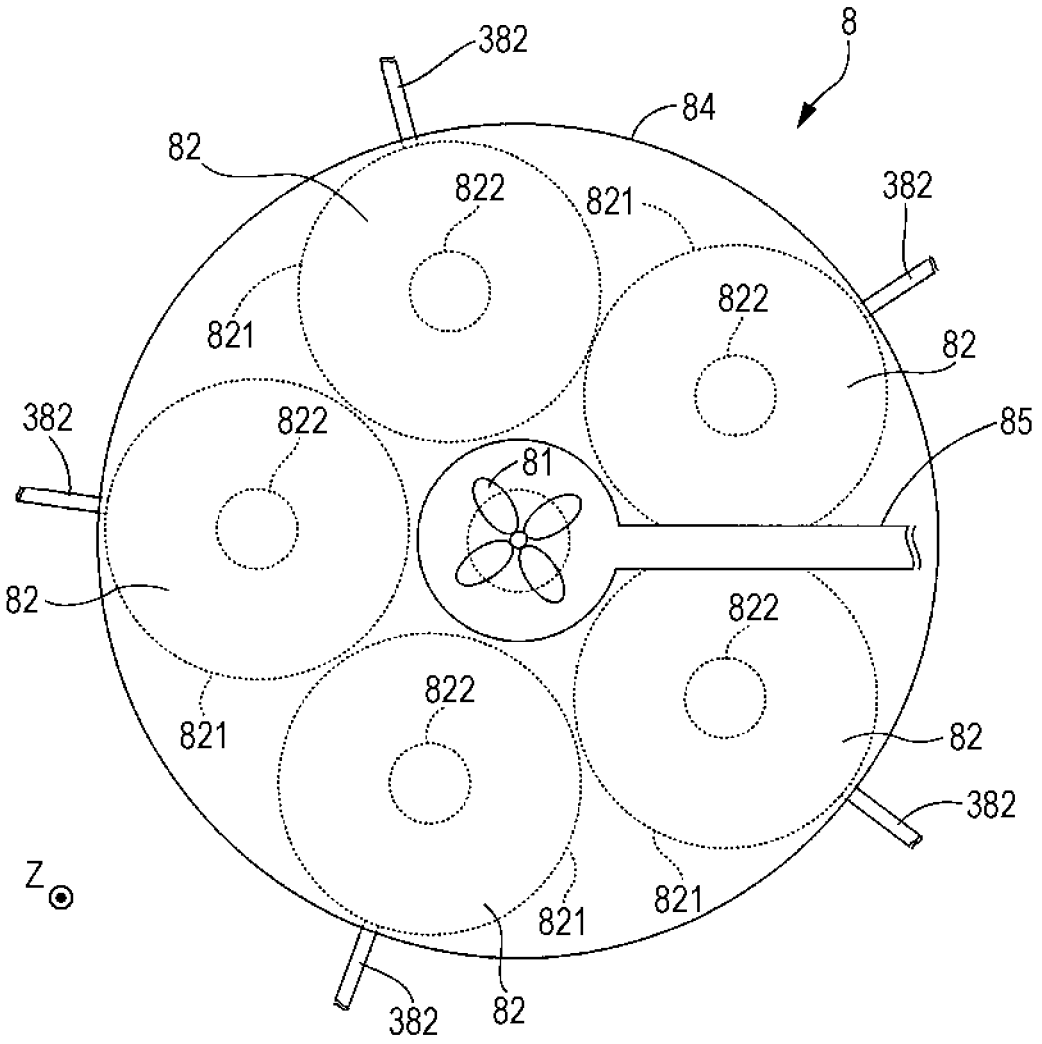
FIG. 2 is a partial plan view which schematically shows one example of a configuration of a gas-liquid separation section.
Figure 3:
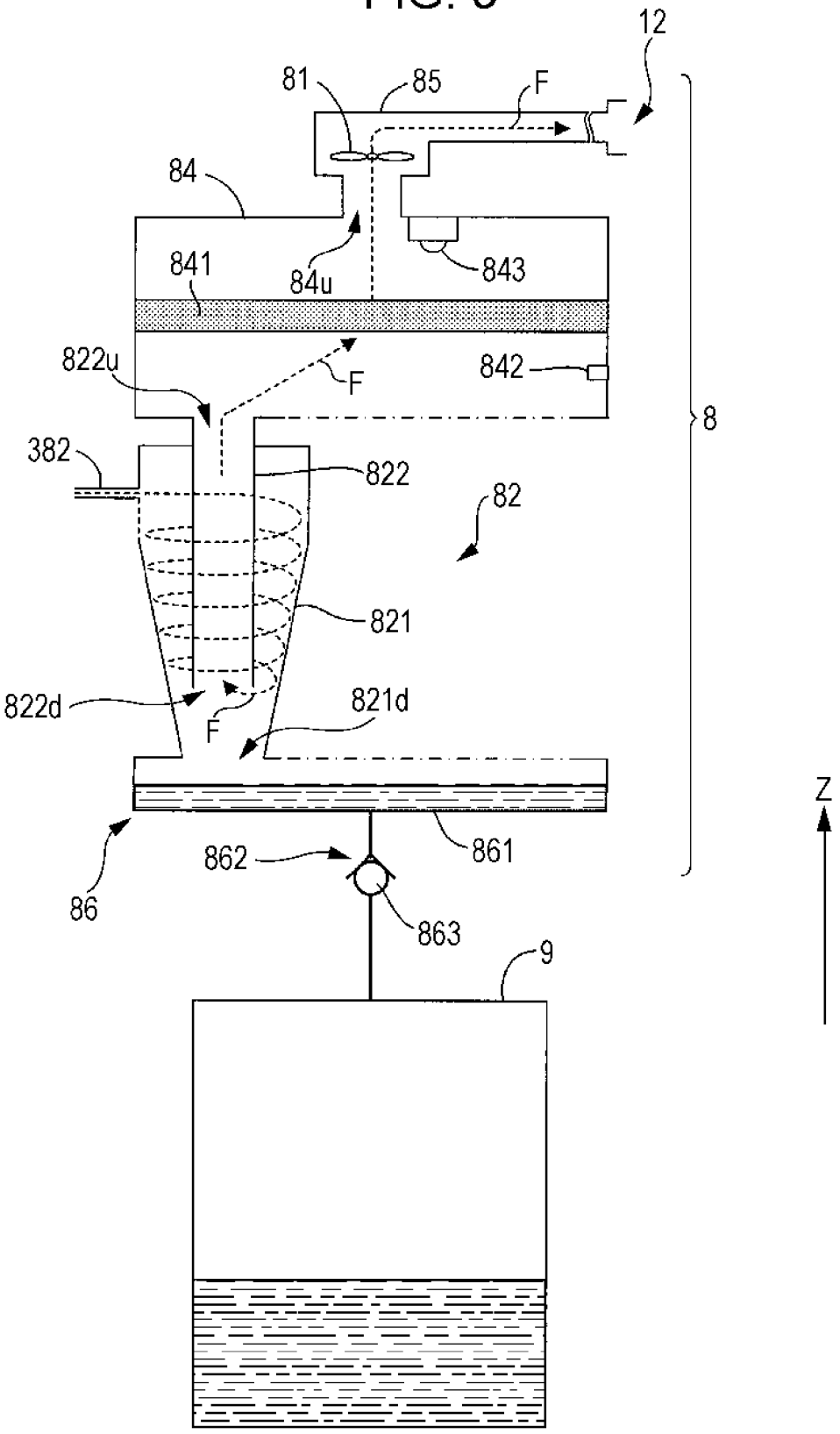
FIG. 3 is a partial sectional view which schematically shows one example of a configuration of the gas-liquid separation section.

FIG. 2 is a partial plan view which schematically shows one example of a configuration of the gas-liquid separation section 8. FIG. 3 is a partial sectional view which schematically shows one example of a configuration of the gas-liquid separation section 8. In FIG. 3, in addition to the gas-liquid separation section 8, a waste liquid tank 9 and the like are also illustrated. As shown in FIGS. 2 and 3, the gas-liquid separation section 8 includes a blower 81 in the top portion in the vertical direction Z. When the blower 81 rotates, the gas flow flows into the gas-liquid separation section 8 through the suction ports 381 and exits the gas-liquid separation section 8 through the exhaust port (the dashed line arrow F in FIG. 3).

As shown in FIG. 2, the gas-liquid separation section 8 includes a plurality of gas-liquid separation cyclones 82 arranged in the circumferential direction at equal intervals. In FIG. 3, only one gas-liquid separation cyclone 82 is illustrated and the remaining gas-liquid separation cyclones 82 are omitted. That is, the individual gas-liquid separation cyclones 82 are provided for each of the plurality of mist suction sections 38, and the suction ports 381 of the mist suction sections 38 are connected to the corresponding gas-liquid separation cyclones 82 via the suction hoses 382. Accordingly, the ink mist suctioned through the suction ports 381 of the mist suction sections 38 reaches the corresponding gas-liquid separation cyclones 82.

The gas-liquid separation cyclone 82 has a cyclone housing 821 formed in a substantially truncated cone shape having a diameter gradually decreasing toward the bottom in the vertical direction Z, and the suction hose 382 is connected to the top of the cyclone housing 821 in the vertical direction Z. The gas-liquid separation cyclone 82 further includes a cyclone muffler 822 in a cylindrical shape which extends in the vertical direction Z. The cyclone muffler 822 is formed in a hollow shape and has an upper opening 822*u* which extends upward from the cyclone housing 821 and a lower opening 822*d* which is located lower than the connection portion of the suction hose 382 in the vertical direction Z.

The gas-liquid separation section 8 includes a filter case 84 which is connected to the upper opening 822*u* of the cyclone muffler 822 of the gas-liquid separation cyclone 82. The filter case 84 is formed in a substantially cylindrical shape which extends in the vertical direction Z and houses a filter 841 with the inner wall of the filter case 84 being in close contact with the filter 841. As a result, the interior of the filter case 84 is divided into two sections, one being on the side of the gas-liquid separation cyclone 82 with respect to the filter 841 and the other being on the opposite side of the gas-liquid separation cyclone 82 with respect to the filter 841. A pressure sensor 842 is disposed in the filter case 84 on the side of the gas-liquid separation cyclone 82, and a UV light source 843 is disposed in the filter case 84 on the opposite side of the gas-liquid separation cyclone 82. The pressure sensor 842 and the UV light source 843 are used to detect a time for replacing the filter 841, the detail of which will be described later.

The gas-liquid separation section 8 includes a blower case 85 which connects an upper opening 84*u* of the filter case 84 to the exhaust port 12 (FIG. 1). The blower 81 which is disposed in the blower case 85 opposes the upper opening 84*u* of the filter case 84. Accordingly, when the blower 81 rotates, the gas flow F indicated by the dashed line arrow in FIG. 3 is generated.

Specifically, the gas flow F enters the cyclone housing 821 of the gas-liquid separation cyclone 82 through the suction hose 382, and then moves downward between the inner wall of the cyclone housing 821 and the outer wall of the cyclone muffler 822 while swirling around the cyclone muffler 822 (that is, moves downward in a spiral manner). When the gas flow F reaches the lower opening 822*d* of the cyclone muffler 822, the gas flow F flows into the cyclone muffler 822. The gas flow F moves upward and reaches the filter case 84. The gas flow F further moves upward in the filter case 84, passes through the filter 841, and reaches the blower case 85. Then, the gas flow F exits through the exhaust port 12 (FIG. 1).

While the gas which contains ink mist moves along the gas flow F, the ink mist can be separated from the gas. That is, as the ink mist contained in the gas is swirled along the gas flow F in the cyclone housing 821, the ink mist is urged outward and is attached to the inner wall of the cyclone housing 821 by centrifugal force caused by the swirling. In this way, ink mist is centrifugally separated from the gas. Then, the gas from which ink mist has been centrifugally separated passes through the filter 841. In so doing, a small amount of ink mist which has not been centrifugally separated from the gas is captured by the filter 841 and separated from the gas. As a result, a clean gas from which ink has been highly effectively removed is exhausted from the exhaust port 12.

The gas-liquid separation section 8 further includes a discharge section 86 that discharges the ink centrifugally separated by the gas-liquid separation cyclone 82 to the outside. The discharge section 86 includes a collecting box 861 into which the centrifugally separated ink is temporarily stored and a check valve 863 that opens and closes a discharge port 862 which communicates with the collecting box 861. The collecting box 861 is connected to the lower opening 821*d* of the cyclone housing 821 such that ink flows down on the inner wall of the cyclone housing 821 into the collecting box 861. The ink in the collecting box 861 is discharged to the outside through the discharge port 862 when the check valve 863 is opened, while the ink is not discharged through the discharge port 862 when the check valve 863 is closed.

The ink discharged through the discharge port 862 is stored in the waste liquid tank 9 which is disposed outside the gas-liquid separation section 8. In the waste liquid tank 9, the ink collected by a waste liquid collecting mechanism other than the gas-liquid separation section 8 is also stored. Such a waste liquid collecting mechanism includes, for example, a mechanism that collects a waste liquid (ink) generated in a maintenance unit which is described in JP-A-2012-086409 that performs maintenance of the print heads 36*a* to 36*e*.

Figure 4:
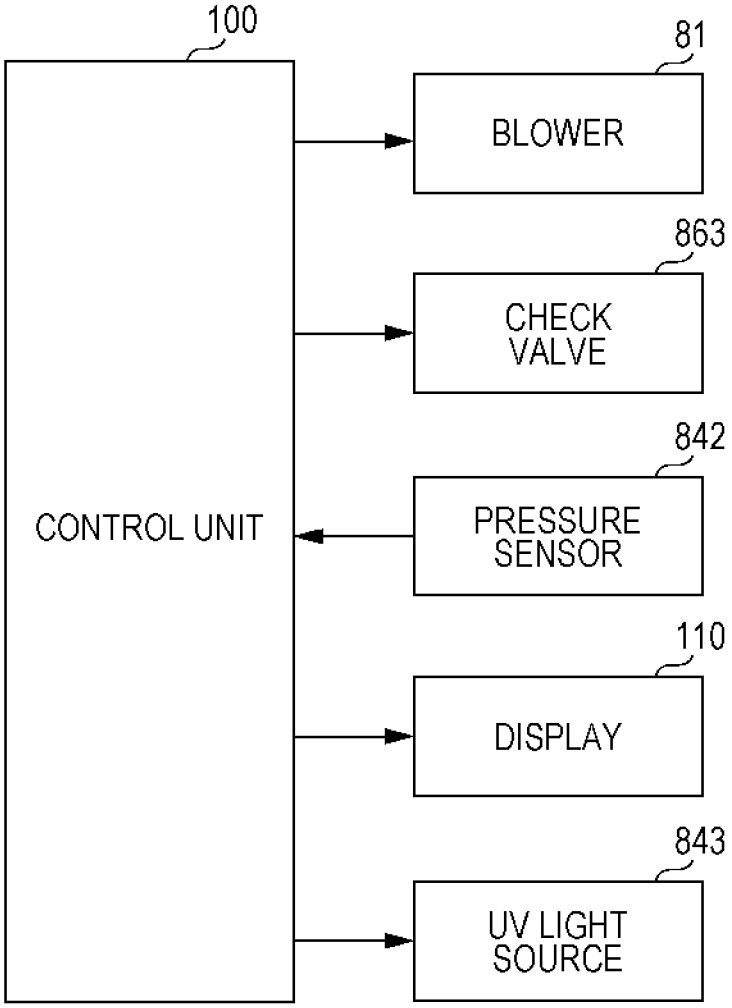
FIG. 4 is a block diagram which shows one example of an electric configuration of the image recording apparatus of FIG. 1.

An operation of the gas-liquid separation section 8 is controlled by a control unit 10 (FIG. 4). FIG. 4 is a block diagram which shows one example of an electric configuration of the image recording apparatus of FIG. 1. A control unit 100 performs ink mist collection, gas-liquid separation and the like during recording of image or in a predetermined time period after recording of image.

Specifically, in starting ink mist collection and gas-liquid separation, the control unit 100 closes the check valve 863 before starting the rotation of the blower 81. Consequently, the gas flow F is generated, which generates a negative pressure inside the cyclone housing 821 and the filter case 84. While the blower 81 continues to rotate, ink mist collection and gas-liquid separation are performed (by the gas-liquid separation cyclone 82 and the filter 841).

During ink mist collection and gas-liquid separation, the control unit 100 monitors a pressure (air pressure) inside the filter case 84 (on the side of the gas-liquid separation cyclone 82 with respect to the filter 841) by the pressure sensor 842. This monitoring of pressure is performed to check the progress of clogging of the filter 841. That is, as the clogging of the filter 841 progresses, the speed of the gas flow F passing through the filter 841 decreases, thereby increasing the pressure inside the filter case 84. When the pressure indicated by the pressure sensor 842 exceeds a threshold, the control unit 100 determines that the filter 841 needs to be replaced and displays on a display 110 which is made by LCD panel or the like to prompt replacement of the filter 841.

If the ink captured by the filter 841 remains in the liquid form, the speed of the gas flow F passing through the filter 841 does not significantly decrease even if the amount of ink captured by the filter 841 increases. As a result, it may be difficult to detect clogging of the filter 841 by the pressure sensor 842. Accordingly, the control unit 100 turns on the UV light source 843 before starting the rotation of the blower 81. The ink (UV ink) captured by the filter 841 is cured by UV light from the UV light source 843 and adheres to the filter 841, thereby increasing a detection sensitivity of clogging of the filter 841.

In terminating ink mist collection and gas-liquid separation, the control unit 100 stops the rotation of the blower 81. Consequently, the gas flow F disappears and a pressure inside the cyclone housing 821 and the filter case 84 returns to the atmospheric pressure. After that, the control unit 100 turns off the UV light source 843 and opens the check valve 863. Accordingly, the ink separated from the gas and stored in the collecting box 861 is discharged into the waste liquid tank 9 via the check valve 863.

As described above, the gas-liquid separation cyclone 82 that performs gas-liquid separation by centrifuge is used in this embodiment. The gas-liquid separation cyclone 82 does not use a filter in gas-liquid separation, and accordingly, does not require replacement of a filter. As a result, the burden of an operator can be reduced.

Moreover, the UV ink is used in this embodiment. The UV ink is cured by irradiation of UV light, not by drying. Accordingly, even if the UV ink is attached to the gas-liquid separation cyclone 82 during gas-liquid separation, the UV ink flows down without being dried and cured. As a result, it is possible to prevent the efficiency of gas-liquid separation from being decreased due to the dried and cured ink adhering to the gas-liquid separation cyclone 82, and maintain a good effect of gas-liquid separation.

In this embodiment, the filter 841 is disposed downstream with respect to the gas flow of the gas-liquid separation cyclone 82. As a consequence, the gas from which ink has been centrifugally separated by the gas-liquid separation cyclone 82 passes through the filter 841, and then is exhausted through the exhaust port 12. Accordingly, ink which has not been separated by the gas-liquid separation cyclone 82 can be removed by the filter 841. The gas to be removed by the filter 841 contains a significantly small amount of ink since gas-liquid separation by the gas-liquid separation cyclone 82 has been already performed. Accordingly, the amount of ink captured by the filter 841 is significantly small, and clogging of the filter 841 progresses slowly. Therefore, replacement frequency of the filter 841 is decreased, and the burden of the operator required for replacement of the filter 841 is relatively small.

In this embodiment, the filter 841 is disposed above the gas-liquid separation cyclone 82 in the gravitational direction Z. Accordingly, even if the ink captured by the filter 841 drops, the dropped ink flows in the direction opposite to the flow of the gas flow F and can be prevented from being discharged to the outside of the image recording apparatus 1.

Further, in this embodiment, the filter case 84 covers a portion between the gas-liquid separation cyclone 82 and the filter 841. Based on the measurement result of the pressure in the filter case 84, a time for replacing the filter 841 is notified. In this configuration, as the ink captured by the filter 841 increases, the speed of the gas flow F passing through the filter 841 decreases and the pressure in the filter case 84 increases. A time for replacing the filter 841 is notified based on the measurement result of the pressure in the filter case 84. Accordingly, replacement of filter can be performed at an appropriate time.

Further, the UV light source 843 that irradiates UV light to the filter 841 is used in this embodiment. In this configuration, the ink captured by the filter 841 can be cured and adhered to the filter 841. As a consequence, the increase in the pressure in the filter case 84 to the increase in the amount of ink captured by the filter 841 can be measured with improved sensitivity, and replacement of filter at an appropriate time can be more reliably performed.

In this embodiment, the UV light source 843 is positioned to irradiate UV light to the filter 841 from a downstream side in the gas flow F. In this configuration, a substantially entire area of the filter 841 can be effectively used to capture ink. Accordingly, the amount of ink captured by the filter 841 before the replacement time can be ensured and the replacement frequency of the filter 841 can be decreased.

Moreover, the filter 841 may be infiltrated with a coagulant such as metal ion that coagulates the UV ink. Such a configuration is advantageous in that the ink captured by the filter 841 can be more fixedly adhered to the filter 841 and the filter 841 can be replaced an appropriate time. However, the coagulant may not be necessarily used in the invention.

In this embodiment, the discharge section 86 is provided so that the ink separated by the gas-liquid separation cyclone 82 is discharged through the discharge port 862 that communicates with the gas-liquid separation cyclone 82. In this configuration, the ink separated by the gas-liquid separation cyclone 82 can be discharged through the discharge port 862 as appropriate.

Further, in this embodiment, the collecting box 861 is disposed between the gas-liquid separation cyclone 82 and the discharge port 862 and is configured such that the ink separated by the gas-liquid separation cyclone 82 is stored in the collecting box 861. The ink stored in the collecting box 861 is discharged through the discharge port 862. In this configuration, the ink separated by the gas-liquid separation cyclone 82 can be temporarily stored in the collecting box 861 and a timing at which ink is discharged can be controlled as appropriate.

Further, in this embodiment, the discharge port 862 is closed while the blower 81 generates the gas flow F and the discharge port 862 is opened while the blower 81 does not generate the gas flow F. In this configuration, the ink is not discharged through the discharge port 862 during gas-liquid separation performed by the gas-liquid separation cyclone 82. Accordingly, it is possible to avoid a situation that discharge of ink through the discharge port 862 disturbs the gas flow F which is necessary for gas-liquid separation and the efficiency of gas-liquid separation decreases.

As described above, in this embodiment, the image recording apparatus 1 corresponds to an example of the "printing apparatus" of the invention, the blower 81 corresponds to an example of the "gas flow generating section" of the invention, the gas-liquid separation cyclone 82 corresponds to an example of the "gas-liquid separation cyclone" of the invention, the sheet S corresponds to an example of the "printing media" of the invention, the ink corresponds to an example of the "liquid" of the invention, and the ink mist corresponds to an example of the "liquid not used for printing" of the invention. Further, the UV light corresponds to an example of the "light" of the invention, the UV ink corresponds to an example of the "light curable liquid" of the invention, the filter 841 corresponds to an example of the "filter" of the invention, the filter case 84 corresponds to an example of the "cover member" of the invention, the pressure sensor 842, the display 110 and the control unit 100 cooperate together to serve as an example of the "notification section" of the invention, the UV light source 843 corresponds to an example of the "light irradiation section" of the invention, the discharge port 862 corresponds to an example of the "discharge port" of the invention, and the collecting box 861 corresponds to an example of the "storage container" of the invention.

The invention is not limited to the foregoing embodiment, and various modification can be made without departing from the spirit of the invention. For example, in the above described embodiment, the invention is described as being applied to gas-liquid separation of the ink mist collected around the print heads 36*a* to 36*e*. However, the application of the invention is not limited to the above embodiment. For example, the invention can also be applied to gas-liquid separation of the waste liquid which is collected from the above described maintenance unit.

Further, the invention can also be applied to a printing apparatus that uses liquid other than the UV ink. That is, the invention can be applied to a printing apparatus in general that performs printing by ejecting liquid onto a printing medium.

Further, the number and a specific configuration of the gas-liquid separation cyclone 82 are not limited to the above description. Accordingly, the number of the gas-liquid separation cyclone 82 may be modified from the above description. Alternatively, a gas-liquid separation cyclone having a configuration which is different from that of the gas-liquid separation cyclone 82 may be used as the gas-liquid separation cyclone of the invention as long as being configured to perform gas-liquid separation by centrifuge.

In the above described embodiment, the gas flow F which is necessary for gas-liquid separation is generated by suctioning performed by the blower 81. However, a specific configuration to generate the gas flow F is not limited to the above description.

Further, configurations associated with the filter 841 can also be modified as appropriate. For example, an interface to notify the operator of a time for replacing the filter 841 is not limited to the above described display 110. A configuration to notify the operator by a sound such as a siren may also be possible.

Further, the light source lamp 843 may not be necessarily provided, and may be omitted as appropriate. Further, the detection of a time for replacing the filter 841 may not be necessarily performed by using the pressure sensor 842 as described above. Specifically, a time for replacing the filter 841 may be detected from the fact that a predetermined amount of printing has been performed after replacement of the filter 841.

Further, positioning of the filter 841 is not limited to the above description, and modifications can be made as appropriate. That is, in the above described embodiment, the positional relationship of the filter 841 and the gas flow F is determined so that the gas flow F flows upward in the gravitational direction Z. However, a configuration in which the gas flow F passes through the filter 841 while flowing downward in the gravitational direction Z or in the horizontal direction may also be possible.

Moreover, the filter 841 itself may be eliminated. Even if the filter 841 is not provided, it is possible to separate the ink from the gas by gas-liquid separation performed by the gas-liquid separation cyclone 82.

The configuration of the discharge section 86 is not limited to the above description. The collection box 861 and the check valve 863 may be eliminated, and the waste liquid tank 9 may be directly connected to the gas-liquid separation cyclone 82.

Further, the shape of the platen 30, the mechanism to transport the sheet S and other components may be modified as appropriate.

The entire disclosure of Japanese Patent Application No. 2013-026335, filed Feb. 14, 2013 is expressly incorporated by reference herein.

What is claimed is:

1. A printing apparatus which performs printing by ejecting liquid onto a printing medium from a print head, comprising:

a gas flow generating section that generates a gas flow to collect and exhaust ink mist that is a part of the liquid ejected from the print head that does not land on the printing medium and is suspended in mist form; and a gas-liquid separation cyclone that swirls the gas flow so that the ink mist is centrifugally separated from a gas which moves along the gas flow, wherein the gas flow generating section exhausts the gas along the gas flow after the ink mist is separated from the gas by the gas-liquid separation cyclone, wherein the gas flow generating section generates the gas flow that causes the ink mist to be collected by at least partially mixing with the gas flow, the gas flow generating section causing the gas flow to be provided to the gas-liquid separation cyclone.

2. The printing apparatus according to claim 1, wherein the liquid is a light curable liquid which is cured by light irradiation.

3. The printing apparatus according to claim 2 further comprising a filter disposed downstream with respect to the gas flow of the gas-liquid separation cyclone, wherein the gas flow generating section exhausts the gas which passes through the filter after the ink mist is separated from the gas by the gas-liquid separation cyclone.

4. The printing apparatus according to claim 3, wherein the filter is disposed above the gas-liquid separation cyclone in a gravitational direction.

5. The printing apparatus according to claim 3 further comprising: a cover member that covers a portion between the gas-liquid separation cyclone and the filter; and a notification section that notifies a time for replacing the filter based on a measurement result of a pressure in the cover member.

6. The printing apparatus according to claim 5 further comprising a light irradiation section that irradiates a light to the filter.

7. The printing apparatus according to claim 6 wherein the light irradiation section irradiates a light to the filter from a downstream side in the gas flow.

8. The printing apparatus according to claim 5 wherein the filter includes a coagulant that coagulates the liquid.

9. The printing apparatus according to claim 1 comprising a discharge section that discharges the ink mist separated by the gas-liquid separation cyclone through the discharge port that communicates with the gas-liquid separation cyclone.

10. The printing apparatus according to claim 9 comprising a storage container that is disposed between the gas-liquid separation cyclone and the discharge port and is configured such that the ink mist separated by the gas-liquid separation cyclone is stored in the storage container, wherein the ink mist stored in the storage container in liquid form is discharged through the discharge port.

11. The printing apparatus according to claim 9, wherein the discharge port is closed while the gas flow generating section generates the gas flow and the discharge port is opened while the gas flow generating section does not generate the gas flow.

* * * * *